US010076163B2

(12) United States Patent
Umekawa et al.

(10) Patent No.: US 10,076,163 B2
(45) Date of Patent: Sep. 18, 2018

(54) ELECTRIC SLIDE FASTENER SYSTEM

(71) Applicant: YKK Corporation, Tokyo (JP)

(72) Inventors: Toru Umekawa, Toyama-Ken (JP); Kazuya Takase, Toyama-Ken (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/649,428

(22) Filed: Jul. 13, 2017

(65) Prior Publication Data

US 2018/0042343 A1 Feb. 15, 2018

(30) Foreign Application Priority Data

Aug. 12, 2016 (JP) ..... 2016-158479

(51) Int. Cl.
*A44B 19/24* (2006.01)
*A44B 19/02* (2006.01)

(52) U.S. Cl.
CPC ..... *A44B 19/24* (2013.01); *A44B 19/02* (2013.01)

(58) Field of Classification Search
CPC ..... A44B 19/02; A44B 19/24; A44B 19/29; A44B 19/303; A44B 19/00; A44B 19/26; A44B 19/262; A44B 19/28; A44B 19/04; A44B 19/06; Y10S 901/46; Y10T 24/2543
See application file for complete search history.

(56) References Cited

U.S. PATENT DOCUMENTS 2,877,439 A * 3/1959 Avery ..... H01R 9/00 200/16 R
2,926,329 A * 2/1960 Crane ..... H01R 9/00 439/285
3,622,936 A * 11/1971 Negishi ..... H01R 13/02 24/411
4,603,327 A * 7/1986 Leonard ..... A44B 19/301 200/DIG. 2
4,755,802 A * 7/1988 Urbanczyk ..... A45C 13/24 116/84
6,747,227 B2 * 6/2004 Marmaropoulos ..... H01H 1/12 200/550
6,805,568 B2 * 10/2004 Kuzmenka ..... H01R 12/774 439/285

(Continued)

FOREIGN PATENT DOCUMENTS

CN 2925174 U 7/2007
CN 204742860 U 11/2015

(Continued)

*Primary Examiner* — Robert Sandy
*Assistant Examiner* — Rowland Do
(74) *Attorney, Agent, or Firm* — Kilpatrick Townsend & Stockton LLP

(57) ABSTRACT

To provide an electric slide fastener system that can operate appropriately according to a state of an electric slider. An electric slide fastener system includes a slide fastener chain that includes a pair of fastener tapes and element rows including a plurality of elements fixed to the respective fastener tapes, a slider that moves with respect to the slide fastener chain, a power supply that supplies power for the slider to move with respect to the slide fastener chain, and a driving part to which the power is supplied from the power supply and that moves the slider with respect to the slide fastener chain. The elements pass through the slider to open or close the element rows. The slider is powered from outside.

5 Claims, 15 Drawing Sheets

(56) References Cited

U.S. PATENT DOCUMENTS

| | | | | |
|---|---|---|---|---|
| 6,870,089 | B1 * | 3/2005 | Gray | H01L 31/042 136/200 |
| 7,073,462 | B1 * | 7/2006 | Layman | A01K 27/006 119/161 |
| 7,304,600 | B2 * | 12/2007 | Nehls | G08C 17/02 340/12.5 |
| 9,231,327 | B1 * | 1/2016 | Liu | H01R 13/22 |
| 9,622,550 | B2 * | 4/2017 | Whiton | A44B 19/285 |
| 2005/0140331 | A1 * | 6/2005 | McQuade | A45C 15/00 320/101 |
| 2010/0136804 | A1 * | 6/2010 | Strickland | H01H 1/12 439/65 |
| 2015/0082582 | A1 | 3/2015 | Whiton | |

FOREIGN PATENT DOCUMENTS

| | | | |
|---|---|---|---|
| JP | 2001-269203 | A | 10/2001 |
| JP | 2009-077947 | A | 4/2009 |

* cited by examiner

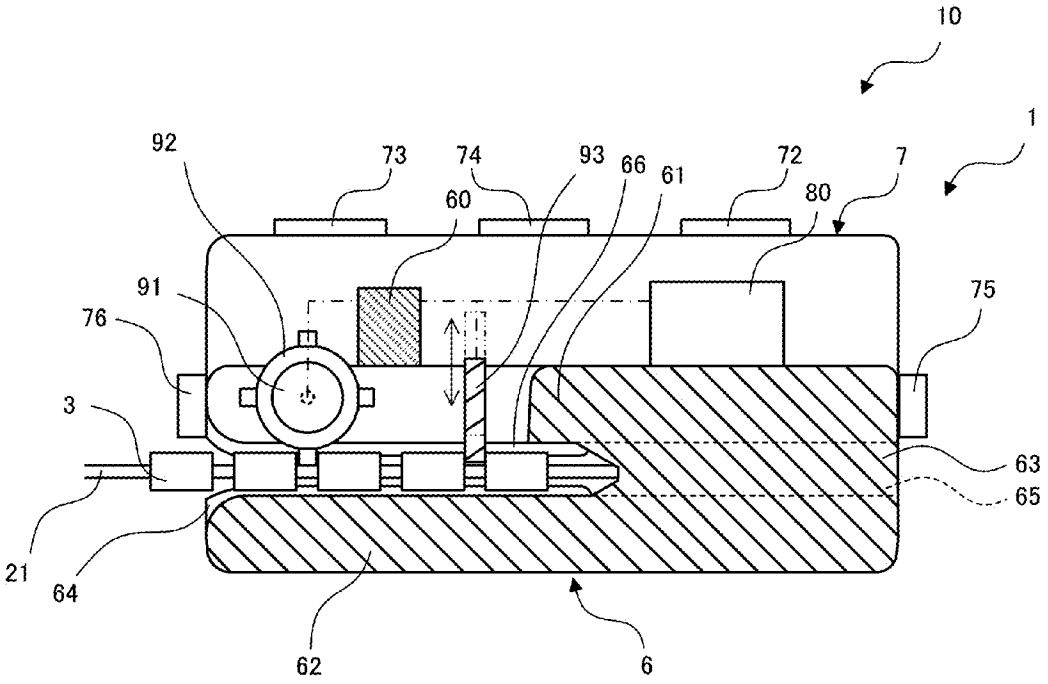
FIG. 2
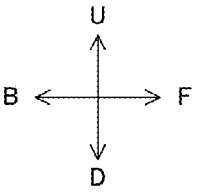

ELECTRIC SLIDE FASTENER SYSTEM

CROSS-REFERENCE TO RELATED APPLICATION

The present application claims priority of Japanese Patent Application No. 2016-158479, filed on Aug. 12, 2016 and entitled "ELECTRIC SLIDE FASTENER SYSTEM", the entire contents of which are hereby incorporated by reference.

TECHNICAL FIELD

The present invention relates to an electric slide fastener system in which a slider is electrically moved.

BACKGROUND ART

Electrically-moved sliders or electric sliders have heretofore been disclosed (JP 2001-269203 A, JP 2009-077947 A, Chinese Utility Model Registration No. 2925174, Chinese Utility Model Registration No. 204742860, and US Patent Application Publication No. 2015/0082582).

For the electric sliders described in JP 2001-269203 A, JP 2009-077947 A, Chinese Utility Model Registration No. 2925174, and Chinese Utility Model Registration No. 204742860, mechanical configurations of electric motors and gear transmission mechanisms are discussed. However, there have still been many defects to be remedied for the sake of practical use. For example, some of the electric sliders are not capable of more complicated operations such as automatic control. Some need to be manually powered on. Dead batteries need to be replaced. When the motors are stopped, the sliders cannot be reliably maintained at the stopped positions.

The electric slider described in US Patent Application Publication No. 2015/0082582 uses a sensor for detecting and controlling the number of zipper teeth by using an optical sensor. However, the electric slide described in US Patent Application Publication No. 2015/0082582 has not yet eliminated all the foregoing disadvantages.

SUMMARY OF THE INVENTION

The present invention has been achieved to solve the foregoing problems. It is therefore an object of the present invention to provide an electric slide fastener system that can operate appropriately according to a state of an electric slider.

An electric slide fastener system according to an embodiment of the present invention includes:

a slide fastener chain that includes a pair of fastener tapes and element rows including a plurality of elements fixed to the respective fastener tapes;

a slider that moves with respect to the slide fastener chain;

a power supply that supplies power for the slider to move with respect to the slide fastener chain; and a driving part to which the power is supplied from the power supply and that moves the slider with respect to the slide fastener chain, the elements passing through the slider to open or close the element rows, wherein the slider is powered from outside.

In the electric slide fastener system according to the embodiment of the present invention, the power supply is mounted on the slider, and the electric slide fastener system includes a power feed mechanism for supplying power to the power supply.

In the electric slide fastener system according to the embodiment of the present invention, as the power feed mechanism, the pair of fastener tapes includes conductive parts that are connected to the power supply and arranged along the respective element rows, and the slider includes contact parts that pass a current from the conductive parts to the power supply.

In the electric slide fastener system according to the embodiment of the present invention, the contact parts are driven by the driving part.

In the electric slide fastener system according to the embodiment of the present invention, the contact parts include contacts made of flexible conductive material, and the contacts make contact with the conductive parts.

The electric slide fastener system according to the embodiment of the present invention includes a resin coating part on a side of the pair of fastener tapes opposite from a side where the conductive parts are arranged.

In the electric slide fastener system according to the embodiment of the present invention, the power feed mechanism includes a solar panel arranged on the slider.

The electric slide fastener system according to the embodiment of the present invention can operate appropriately according to a state of the electric slider.

BRIEF DESCRIPTION OF THE DRAWINGS

FIG. 2 is a sectional view of a slider of the electric slide fastener system according to the first embodiment, taken along line II-II of FIG. 1;

DESCRIPTION OF THE EMBODIMENTS

Hereinafter, an electric slider 6 and an electric slide fastener system 10 according to an embodiment of the present invention will be concretely described below with reference to the drawings.

Figure 1:
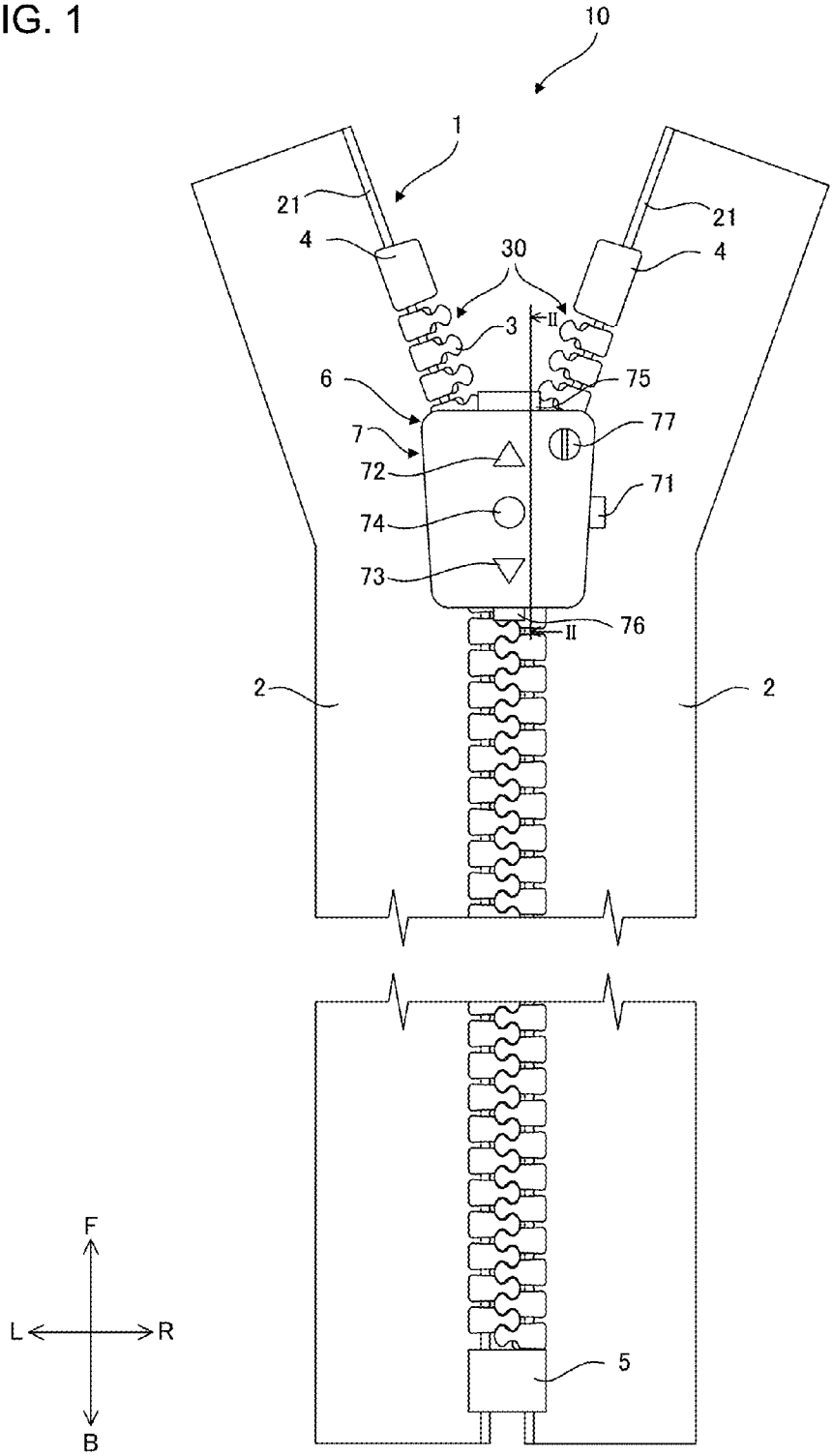
FIG. 1 is a front view of an electric slide fastener system according to a first embodiment.

FIG. 1 is a front view of an electric slide fastener system 10 according to a first embodiment. FIG. 2 is a sectional view of a slider 6 of the electric slide fastener system according to the first embodiment, taken along line II-II of FIG. 1.

The slide fastener system 10 according to the first embodiment includes a pair of fastener tapes 2, 2, a plurality of elements 3, stops 4 and 5, and the slider 6. The plurality of elements 3 is formed at predetermined intervals along opposed conductive parts 21 of the respective fastener tapes 2. The plurality of elements 3 forms element rows 30, at ends of which the stops 4 and 5 are fixed to the conductive parts 21 of the fastener tapes 2. The slider 6 moves along the elements 3 to mesh or unmesh the elements 3. The element rows 30 have ends in the forward and backward directions of a slide fastener chain 1. The stops include top stops 4 which are arranged at the front ends of the element rows 30, and a bottom stop 5 which is arranged at the rear ends of the element rows 30. The elements 3 and the stops are made of resin material.

With respect to the slide fastener chain 1 of the present embodiment, the longitudinal direction of the fastener tapes 2 will be referred to as a forward and backward direction (F-B direction) and indicated by the arrows F and B. The width direction of the fastener tapes 2 will be referred to as a left-to-right direction (L-R direction) and indicated by arrows L and R. The front and back direction of the fastener tapes 2 will be referred to as an up-and-down direction (U-D direction) and indicated by the arrows U and D.

The slide fastener chain 1 includes the left and right, a pair of fastener tapes 2, and the plurality of elements 3 which is fixed to the opposed conductive parts 21 of the respective fastener tapes 2 at predetermined intervals in the longitudinal direction of the fastener tape 2. The slider 6 can move along the elements 3 in the forward and backward direction of the slide fastener chain 1 to mesh or unmesh the elements 3.

The fastener tapes 2 include the conductive parts 21 which protrude from the upper and lower surfaces of the fastener tapes 2 and extend in the forward and backward direction of the fastener tapes 2. The elements 3 are attached to the conductive parts 21 of the fastener tapes 2. An upper surface 2*a* side of the fastener tapes 2 refers to a side that is visible when the fastener tapes 2 are attached as a slide fastener to clothing, a bag, etc. A lower surface 2*b* side refers to the opposite side. The present embodiment deals with an example in which the conductive parts 21 can be used to feed electricity from outside. However, if the feeding of power from outside is not needed, the conductive parts 21 may be spared and the fastener tapes 2 may have a core tape structure of a normal fastener tape.

The top stops 4 are arranged at the front ends of the respective element rows 30 on the pair of fastener tapes 2. Only one bottom stop 5 is arranged at the bottom end of the element rows 30 on the pair of fastener tapes 2. The bottom stop 5 connects the fastener tapes 2 so that the fastener tapes 2 do not separate up when the elements 3 are separated. The bottom stop 5 is not limited to the illustrated example. For example, the bottom stop 5 may include unillustrated insertion pin and box. The insertion pin is fixed to the bottom end of the element row 30 of one of the fastener tapes 2. The box is fixed to the bottom end of the element row 30 of the other fastener tape 2 and has an unillustrated hole into which the insertion pin can be inserted. In such a case, the fastener tapes 2 can be separated when the elements 3 are separated. The slider 6 can move between the top stops 4 and the bottom stop 5 in the forward and backward direction of the slide fastener chain 1.

A body 61 of the slider 6 includes an upper wing plate 61 and a lower wing plate 62. A forward F side of the upper wing plate 61 and a forward F side of the lower wing plate 62 are coupled by a guide pillar 63. Unillustrated upper wing flanges for guiding the fastener elements 3 are protruded from respective lateral side edges of the upper and lower wing plates 61 and 62 on a backward B side. Shoulder ports 64 are formed between the upper and lower wing plates 61 and 62, at both lateral sides of the guide pillar 63 on the forward side of the body 61. A rear port 65 is formed in the rear end of the body 61. Guide grooves 66 for guiding the fastener elements 3 are formed to communicate between the shoulder ports 64 and the rear port 65.

Figure 3:
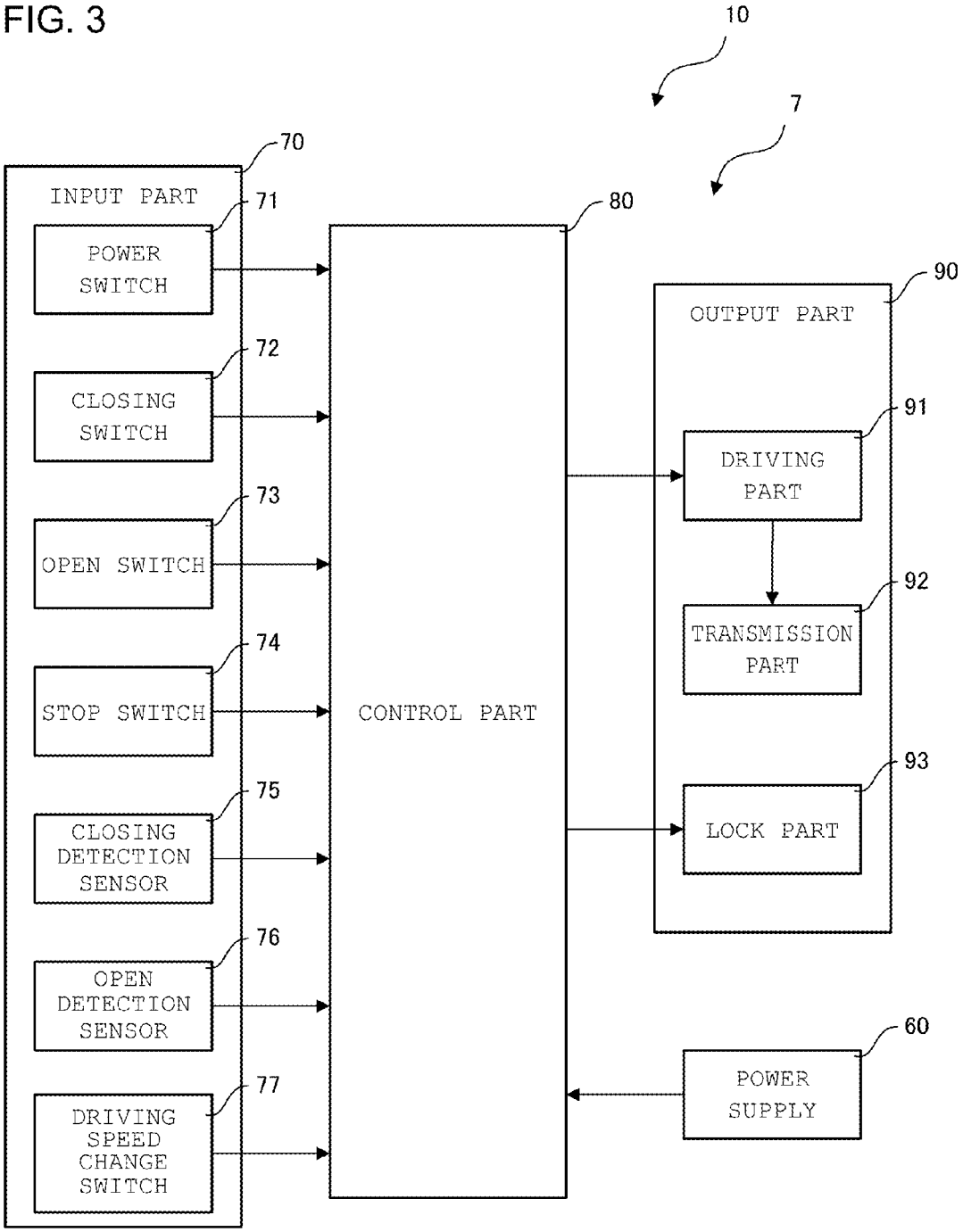
FIG. 3 illustrates a control block diagram of the electric slide fastener system according to the first embodiment.

FIG. 3 illustrates a control block diagram of the electric slide fastener system 10 according to the first embodiment.

The slider 6 includes a control unit 7. The control unit 7 includes a power supply 60, an input part 70, a control part 80, and an output part 90. The slider 6 also has the function and role of a wireless receiver for receiving a wireless signal for opening and closing the slide fastener. The power supply 60 preferably is a rechargeable battery. If the conductive parts 21 are not used, the power supply 60 may be a replaceable throwaway battery. If the power supply 60 is a rechargeable battery, the power supply 60 can be recharged by a power feeding method to be described later during use.

The input part 70 includes a power switch 71, a closing switch 72, an open switch 73, a stop switch 74, a closing detection sensor 75, an open detection sensor 76, and a driving speed change switch 77.

The power switch 71 is a switch for starting energization from the power supply 60 in the control unit 7. The power switch 71 is formed as a push button switch, a slide switch, or the like. The closing switch 72 is a switch for moving the slider 6 in a closing direction. The closing switch 72 is formed as a push button switch, a slide switch, or the like. For example, if the closing switch 72 is turned on, a driving part 91 is driven to move the slider 6 in the closing direction. The open switch 73 is a switch for moving the slider 6 in an open direction. The open switch 73 is formed as a push button switch, a slide switch, or the like. For example, if the open switch 73 is turned on, the driving part 91 is driven to move the slider 6 in the open direction. As illustrated in FIG. 1, the closing switch 72 and the open switch 73 according to the first embodiment are formed as push button switches of triangular shape with their apexes in the moving directions.

The stop switch 74 is a switch for stopping the movement of the slider 6. The stop switch 74 is formed as a push button switch, a slide switch, or the like. For example, if the stop switch 74 is turned on, the driving part 91 is stopped to stop the movement of the slider 6. As illustrated in FIG. 1, the stop switch 74 according to the first embodiment is formed as a round push button switch between the closing switch 72 and the open switch 73. A slide switch may be formed so that the slider 6 stops if the slide switch is positioned at the center, the slider 6 moves in the closing direction if the slide switch is positioned in the closing direction, and the slider 6 moves in the open direction is the slide switch is positioned in the open direction.

The closing detection sensor 75 and the open detection sensor 76 are sensors for detecting that the slider 6 reaches the stops 4 and 5. As illustrated in FIG. 1, in the first embodiment, the closing detection sensor 75 detects that the slider 6 comes into contact with the top stops 4. The open detection sensor 76 detects that the slider 6 comes into contact with the bottom stop 5. Optical sensors and the like may be used to detect that the slider 6 reaches the stops 4 and 5.

The driving speed change switch 77 is a switch for changing the driving speed of the driving part 91 to change the moving speed of the slider 6. The driving speed change switch 77 according to the first embodiment is a dial switch for adjusting the driving speed in a rotary manner. The driving speed change switch 77 may be a slide switch or a push button switch.

The output part 90 includes the driving part 91, a transmission part 92, and a lock part 93. The driving part 91 moves the slider 6 by using rotational force occurring in the transmission part 92. The lock part 93 locks the slider 6 so as not to move when the slider 6 is stopped. For the driving part 91 and the transmission part 92, various configurations have been known, including those described in JP 2001-269203 A, JP 2009-077947 A, Chinese Utility Model Registration No. 2925174, Chinese Utility Model Registration No. 204742860, and US Patent Application Publication No. 2015/0082582. The driving part 91 and the transmission part 92 here are therefore illustrated in a simplified form. The arranged positions of the driving part 91 and the transmission part 92 described in the present specification are just an example. The rotational force of the transmission part 92 has only to be converted into advancing force of the slider 6. For example, it should be understood that the present invention covers implementation with various configurations of transmission parts, including those described in JP 2001-269203 A, JP 2009-077947 A, Chinese Utility Model Registration No. 2925174, Chinese Utility Model Registration No. 204742860, and US Patent Application Publication No. 2015/0082582, and ones that are conceivable from such configurations in view of mechanical design.

In the first embodiment, as illustrated in FIG. 2, a motor is used as the driving part 91 to rotate a gear serving as the transmission part 92. The transmission part 92 includes a speed reducer set at an appropriate reduction ratio. The rotating gear is rotatably supported on the slider 6. The closing switch 72 or the open switch 73 is turned on to drive the driving part 91. The gear rotates and moves in mesh with the elements 3, whereby the slider 6 moves. The stop switch 74 is then turned on to stop the driving part 91. A torque limiter function is preferably added to the driving part 91 so that the driving part 91 stops if the torque of the driving part 91 exceeds a threshold.

In the first embodiment, the lock part 93 is movably supported on the slider 6 so that the lock part 93 can move into and away from between adjoining elements 3. The lock part 93 moves into between the elements 3 after the stop switch 74 is turned on, the driving part 91 stops, and the slider 6 stops. The insertion of the lock part 93 between the elements 3 locks the slider 6 at that position. If the closing switch 72 or the open switch 73 is turned on afterward, the lock part 93 unlocks. The lock part 93 may be actuated after the closing detection sensor 75 or the open detection sensor 76 is turned on, the driving part 91 stops, and the slider 6 stops. The lock part 93 preferably includes a mechanism capable of unlocking by a manual operation for situations when the power supply to the slider 6 stops.

The lock part 93 is configured to be movable by an actuator such as a solenoid. For example, the lock part 93 may be configured to be biased toward between the elements 3 by a spring or the like, and drawn out from between the elements 3 if the actuator is activated. Note that the lock part 93 does not necessarily need to be provided.

Figure 4:
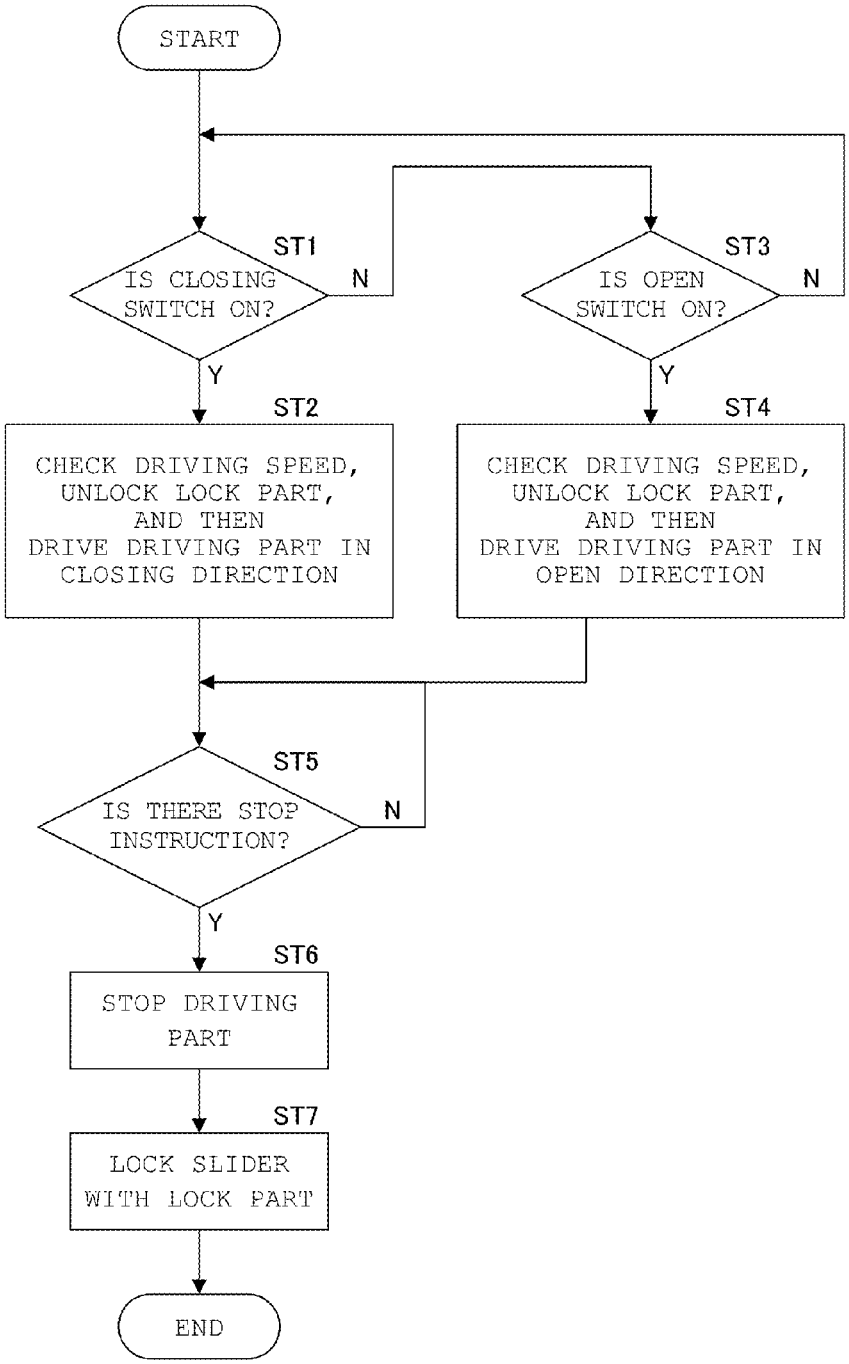
FIG. 4 illustrates a control flow of the electric slide fastener system according to the first embodiment.

FIG. 4 illustrates a control flow of the electric slide fastener system 10 according to the first embodiment.

The control part 80 of the electric slide fastener system 10 according to the first embodiment, illustrated in FIG. 3 starts control when the power switch 71 is turned on.

In step 1, the control part 80 determines whether the closing switch 72 is turned on (ST1). In step 1, if the closing switch 72 is turned on, the processing proceeds to step 2. In step 1, if the closing switch 72 is not turned on, the processing proceeds to step 3.

In step 2, the control part 80 checks the driving speed, unlocks the lock part 93, and then drives the driving part 91 in the closing direction (ST2). The processing then proceeds to step 5. If the lock part 93 is not provided, the unlocking of the lock part 93 is not performed.

In step 3, the control part 80 determines whether the open switch 73 is turned on (ST3). In step 3, if the open switch 73 is turned on, the processing proceeds to step 4. In step 3, if the open switch 73 is not turned on, the processing returns to step 1.

In step 4, the control part 80 checks the driving speed, unlocks the lock part 93, and then drives the driving part 91 in the open direction (ST4). The processing then proceeds to step 5. If the lock part 93 is not provided, the unlocking of the locking part 93 is not performed.

In step 5, the control part 80 determines whether there is a stop instruction (ST5). In the first embodiment, the stop instruction refers to the turning on of the stop switch 74, the closing detection sensor 75, or the open detection sensor 76. The stop switch 74 determines whether the switch is turned on by the operator. The closing detection sensor 75 and the open detection sensor 76 determine whether the slider 6 reaches the stops 4 and 5, respectively.

In step 5, if there is a stop instruction, the processing proceeds to step 6. In step 5, if there is no stop instruction, the processing returns to step 5. In other words, the driving part 91 is driven until a stop instruction is given.

In step 6, the control part 80 stops the driving part 91 according to the stop instruction (ST6). Stopping the driving part 91 stops the slider 6. If the stop switch 74 is turned on, the slider 6 stops at that position. If the closing detection sensor 75 is turned on, the slider 6 stops in contact with the top stops 4. If the open detection sensor 76 is turned on, the slider 6 stops in contact with the bottom stop 5.

Next, in step 7, the lock part 93 moves to lock the movement of the slider 6 (ST7). If the lock part 93 is not provided, step 7 is not performed.

The electric slide fastener system 10 can thus be controlled to detect the state of the slider 6 and control the slider 6 according to the state for appropriate operation. The closing of the element rows 30 is detected from the contact with the top stops 4 which are arranged at the closing-side ends of the element rows 30. The opening of the element rows 30 is detected from the contact with the bottom stop 5 which is arranged the open-side ends of the element rows 30. The slider 6 can thus be stopped by appropriately detecting the completion of closing and the completion of opening of the element rows 30.

If the lock part 93 is provided, the slider 6 is locked so as not to move with respect to the slide fastener chain 1 after the slider 6 stops. The slider 6 can thus be stably stopped in a desired position for higher convenience and usability.

Figure 5:
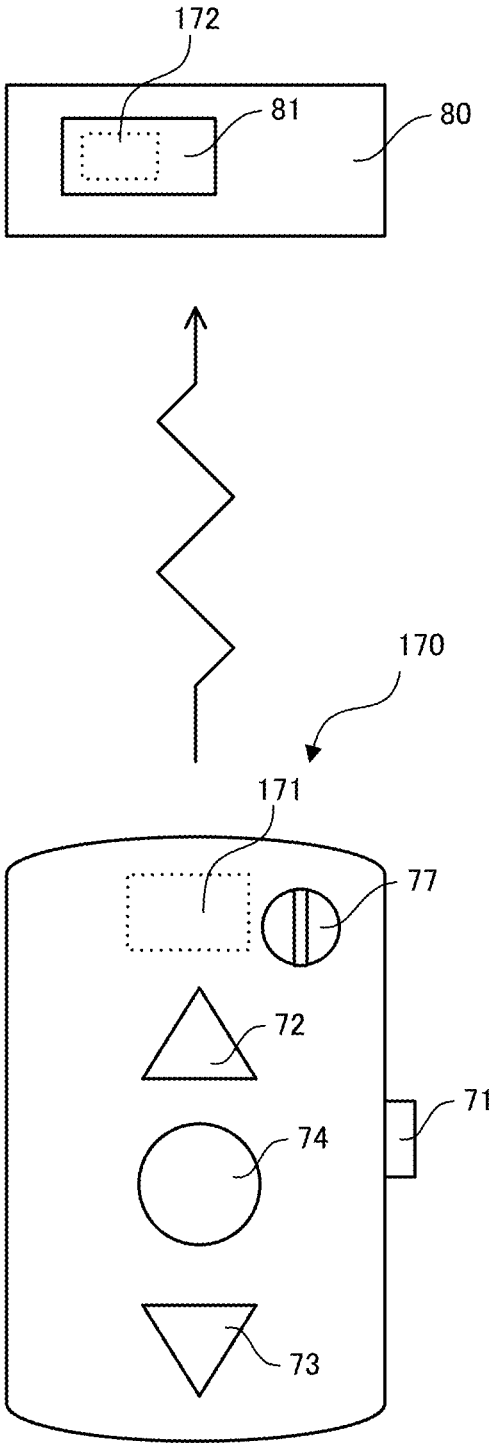
FIG. 5 illustrates a wireless input part of the electric slide fastener system according to the first embodiment.

FIG. 5 illustrates a wireless input part 170 of the electric slide fastener system 10 according to the first embodiment. The wireless input part 170 functions as a wireless transmitter for transmitting wireless signals for opening and closing the slide fastener to the slider 6 to remotely control the slider 6.

The wireless input part 170 includes a power switch 71, a closing switch 72, an open switch 73, a stop switch 74, and a driving speed change switch 77. The wireless input part 170 includes a first wireless signal conversion part 171 which generates wireless signals according to an operation status of the closing switch 72, the open switch 73, and the stop switch 74. The wireless input part 170 wirelessly transmits the signals to the control part 80 of the slider 6. The control part 80 includes a reception part 81 which receives the signals from the wireless input part 170. The control part 80 includes a second wireless conversion part 172 which converts the wireless signals transmitted according to the operation status of the closing switch 72, the open switch 73, and the stop switch 74 of the wireless input part 170 serving as the wireless transmitter into a driving signal of the driving part 91 of the slider 6. Details of the operations of the slider 6 according to the respective switches are the same as those with the foregoing input part 70.

A mobile communication terminal of touch panel type may be used as a wireless input part 270. More specifically, a smartphone may be used. In such a case, a dedicated application is preferably used for operation. A button arrangement illustrated as the wireless input part 270 in FIG. 9 may be displayed on the screen of the mobile communication terminal.

The provision of the wireless input part 170 enables the slider 6 to be controlled from a position remote from the slider 6.

Figure 6:
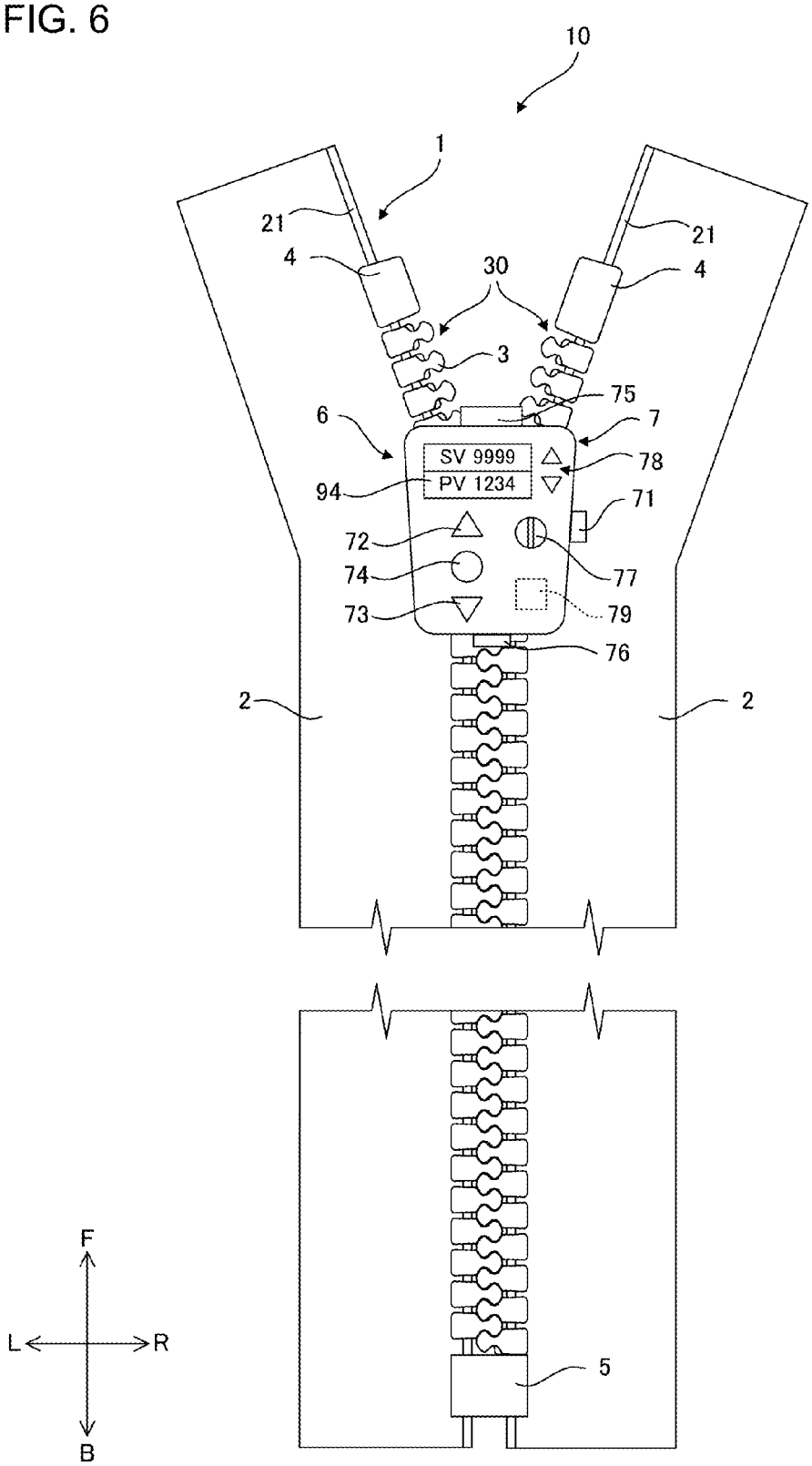
FIG. 6 is a front view of an electric slide fastener system according to a second embodiment.

FIG. 6 is a front view of an electric slide fastener system 10 according to a second embodiment.

A slide fastener chain 1 of the electric slide fastener system 10 according to the second embodiment has the same configuration as that of the first embodiment. A description thereof will thus be omitted.

Figure 7:
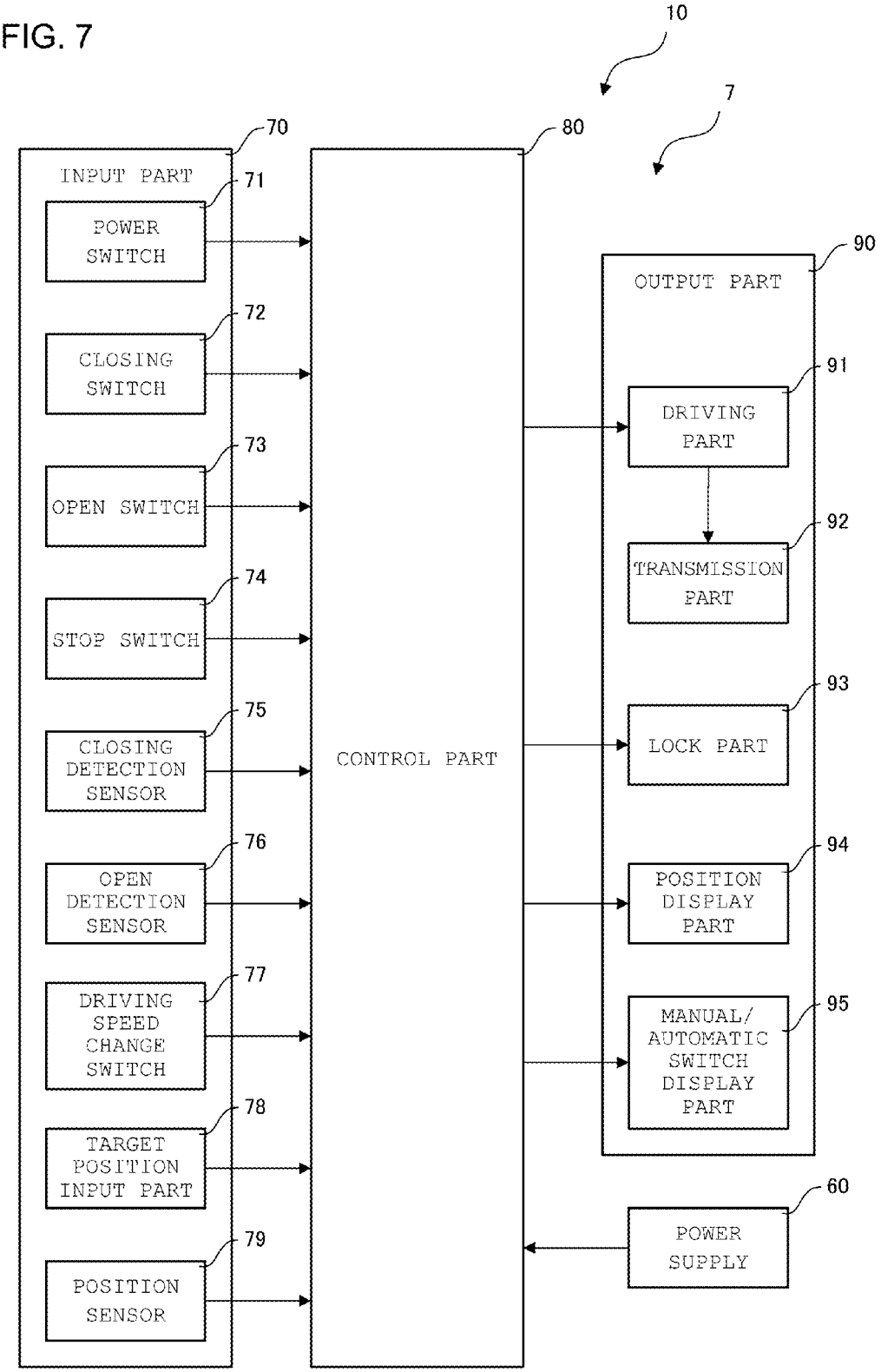
FIG. 7 illustrates a control block diagram of the electric slide fastener system according to the second embodiment.

FIG. 7 illustrates a control block diagram of the electric slide fastener system 10 according to the second embodiment.

A slider 6 includes a control unit 7. The control unit 7 includes an input part 70, a control part 80, and an output part 90.

The input part 70 includes a power switch 71, a closing switch 72, an open switch 73, a stop switch 74, a closing detection sensor 75, an open detection sensor 76, a driving speed change switch 77, a target position input part 78, and a position sensor 79. The output part 90 includes a driving part 91, a transmission part 92, a lock part 93, a position display part 94, and a manual/automatic switch display part 95. The control unit 7 according to the second embodiment is the same as that of the first embodiment except in the target position input part 78, the position sensor 79, the position display part 94, and the manual/automatic switch display part 95. A description of the configuration other than the target position input part 78, the position sensor 79, the position display part 94, and the manual/automatic switch display part 95 will thus be omitted.

If the positions of the top stops 4 and the bottom stop 5 are stored in advance as an upper limit and a lower limit of the target position input part 78, the closing detection sensor 75 and the opening detection sensor 76 do not need to be used. In such a case, a torque limiter function is preferably added to the driving part 91 so that the driving part 91 stops if the torque of the driving part 91 exceeds a threshold.

The target position input part 78 inputs a target position to move the slider 6 to. In the present embodiment, as illustrated in FIG. 6, the target position input part 78 includes push button switches of triangular shape with their apexes in the moving directions. The buttons can be pressed to set a target position. The target position is set in units of the number of elements 3, a distance from the current position of the slider 6, a distance from the top stops 4 or the bottom stop 5, time, etc.

The position sensor 79 detects the position of the slider 6. The position of the slider 6 is detected by a method of detecting and counting the elements 3 by contact or optically, a method of detecting a distance from the top stops 4 or the bottom stop 5, a method of installing a part to be detected in a predetermined location and detecting the part to be detected, etc.

The position display part 94 displays the target position input by the target position input part 78, the position of the slider 6 detected by the position sensor 79, etc. For example, the position display part 94 according to the second embodiment displays "9999" input by the target position input part 78 at the position of a target position SV, and "1234" detected by the position sensor 79 at the position of a current value PV.

Figure 8:
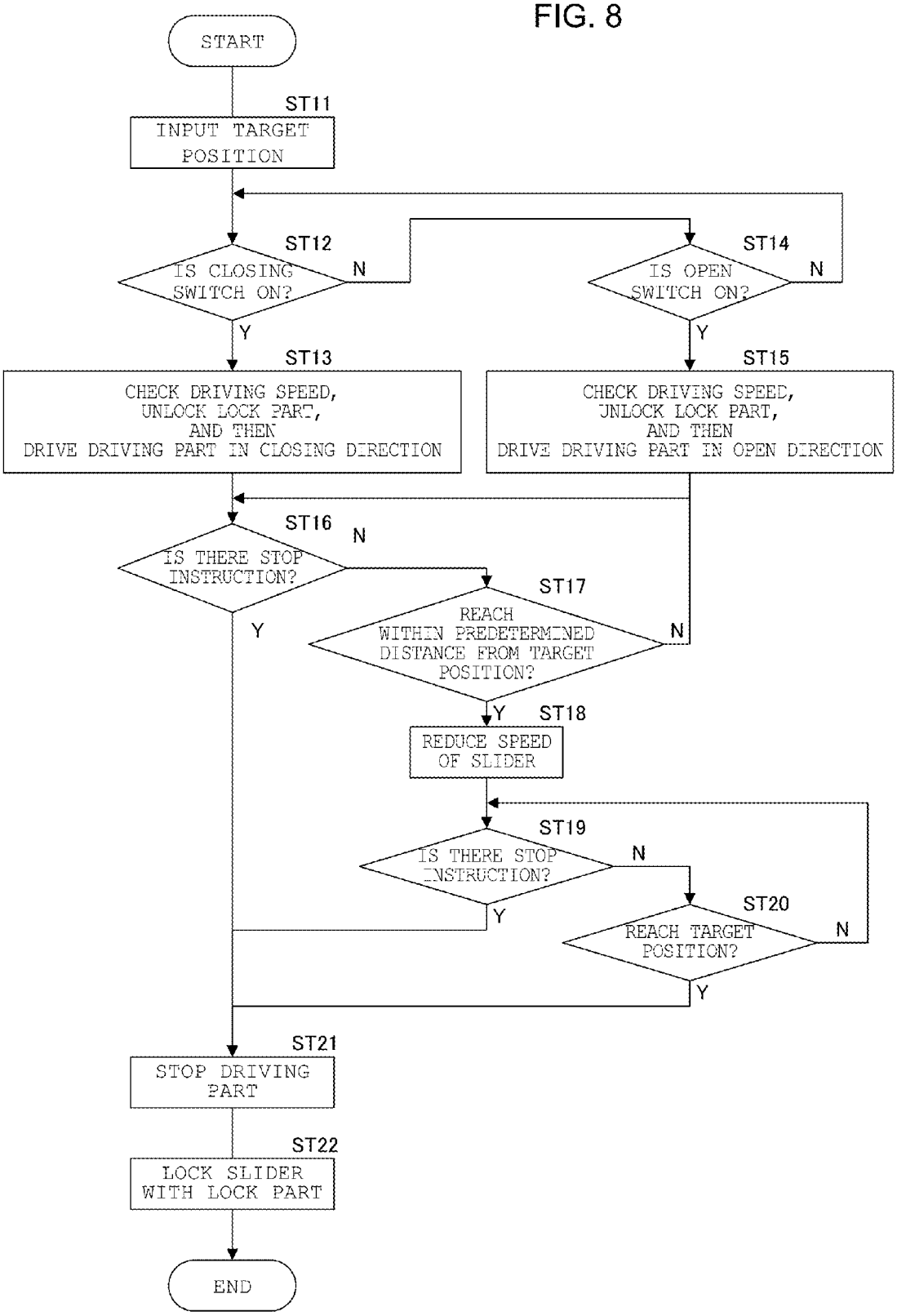
FIG. 8 illustrates a control flow of the electric slide fastener system according to the second embodiment.

FIG. 8 illustrates a control flow of the electric slide fastener system 10 according to the second embodiment.

The control part 80 of the electric slide fastener system 10 according to the second embodiment, illustrated in FIG. 7 starts control when the power switch 71 is turned on.

In step 11, the control part 80 initially inputs a target position from the target position input part 78 (ST11). The input target position is displayed on the position display part 94.

In step 12, the control part 80 determines whether the closing switch 72 is turned on (ST12). In step 12, if the closing switch 72 is turned on, the processing proceeds to step 13. In step 12, if the closing switch 72 is not turned on, the processing proceeds to step 14.

In step 13, the control part 80 checks the driving speed, unlocks the lock part 93, and then drives the driving part 91 in the closing direction (ST13). The processing then proceeds to step 15. If the lock part 93 is not provided, the unlocking of the lock part 93 is not performed.

In step 14, the control part 80 determines whether the open switch 73 is turned on (ST14). In step 14, if the open switch 73 is turned on, the processing proceeds to step 15. In step 14, if the open switch 73 is not turned on, the processing returns to step 12.

In step 15, the control part 80 checks the driving speed, unlocks the lock part 93, and then drives the driving part 91 in the open direction (ST15). The processing then proceeds to step 16. If the lock part 93 is not provided, the unlocking of the lock part 93 is not performed.

In step 16, the control part 80 determines whether there is a stop instruction (ST16). In the second embodiment, the stop instruction refers to the turning on of the stop switch 74, the closing detection sensor 75, or the open detection sensor 76. The stop sensor 74 determines whether the switch is turned on by the operator. The closing detection sensor 75 and the open detection sensor 76 determine whether the slider 6 reaches the top stops 4 and the bottom stop 5, respectively.

In step 16, if there is a stop instruction, the processing proceeds to step 21. In step 16, if there is no stop instruction, the processing proceeds to step 17.

In step 17, the control part 80 determines whether the slider 6 reaches within a predetermined distance from the target position (ST17). Whether the slider 6 reaches within a predetermined distance from the target position may be determined by determining whether a distance from the position of the slider 6 detected by the position sensor 79 to the target position input to the target position input part 78 is smaller than the predetermined distance.

In step 17, if the slider 6 is determined to reach within the predetermined distance from the target position, the processing proceeds to step 18. In step 17, if the slider 6 is determined to not reach within the predetermined distance from the target position, the processing returns to step 16.

In step 18, the control part 80 reduces the moving speed of the slider 6 (ST18). The speed of the slider 6 may be reduced by using a method of reducing the speed of rotation of the driving part 91, a method of providing an unillustrated speed changer part and changing the number of rotations transmitted from the driving part 91 to the transmission part 92, etc.

In step 19, the control part 80 determines whether there is a stop instruction (ST19). The stop instruction is determined in the same manner as in step 16.

In step 19, if there is a stop instruction, the processing proceeds to step 21. In step 19, if there is no stop instruction, the processing proceeds to step 20.

In step 20, the control part 80 determines whether the slider 6 reaches the target position (ST20). Whether the slider 6 reaches the target position may be determined by determining whether the distance from the position of the slider 6 detected by the position sensor 79 to the target position input to the target position input part 78 is zero.

In step 20, if the slider 6 is determined to reach the target position, the processing proceeds to step 21. In step 20, if the slider 6 is determined to not reach the target position, the processing returns to step 19.

In step 21, the control part 80 stops the driving part 91 according to the stop instruction (ST21). Stopping the driving part 91 stops the slider 6. If the stop switch 74 is turned on, the slider 6 stops at that position. If the closing detection sensor 75 is turned on, the slider 6 stops in contact with the top stops 4. If the open detection sensor 76 is turned on, the slider 6 stops in contact with the bottom stop 5.

Next, in step 22, the lock part 93 moves to lock the movement of the slider 6 (ST22). If the lock part 93 is not provided, step 22 is not performed.

The electric slide fastener system 10 can thus be controlled to detect the state of the slider 6 and control the slider 6 according to the state for appropriate operation. In addition, the slider 6 can be stopped in a desired position for higher convenience and usability. If the slider 6 reaches within a predetermined distance from the target position, the moving speed of the slider 6 is reduced. This can suppress a rapid change in speed and reduce failures.

If the lock part 93 is provided, the slider 6 is locked so as not to move with respect to the slide fastener chain 1 after the slider 6 stops. The slider 6 can thus be stably stopped in a desired position for higher convenience and usability.

Since the position display part 94 which displays the target position input by the target position input part 78 and the position of the slider 6 detected by the position sensor 79 is included, the position of the slider 6 with respect to the target position can be instantaneously determined.

Figure 9:
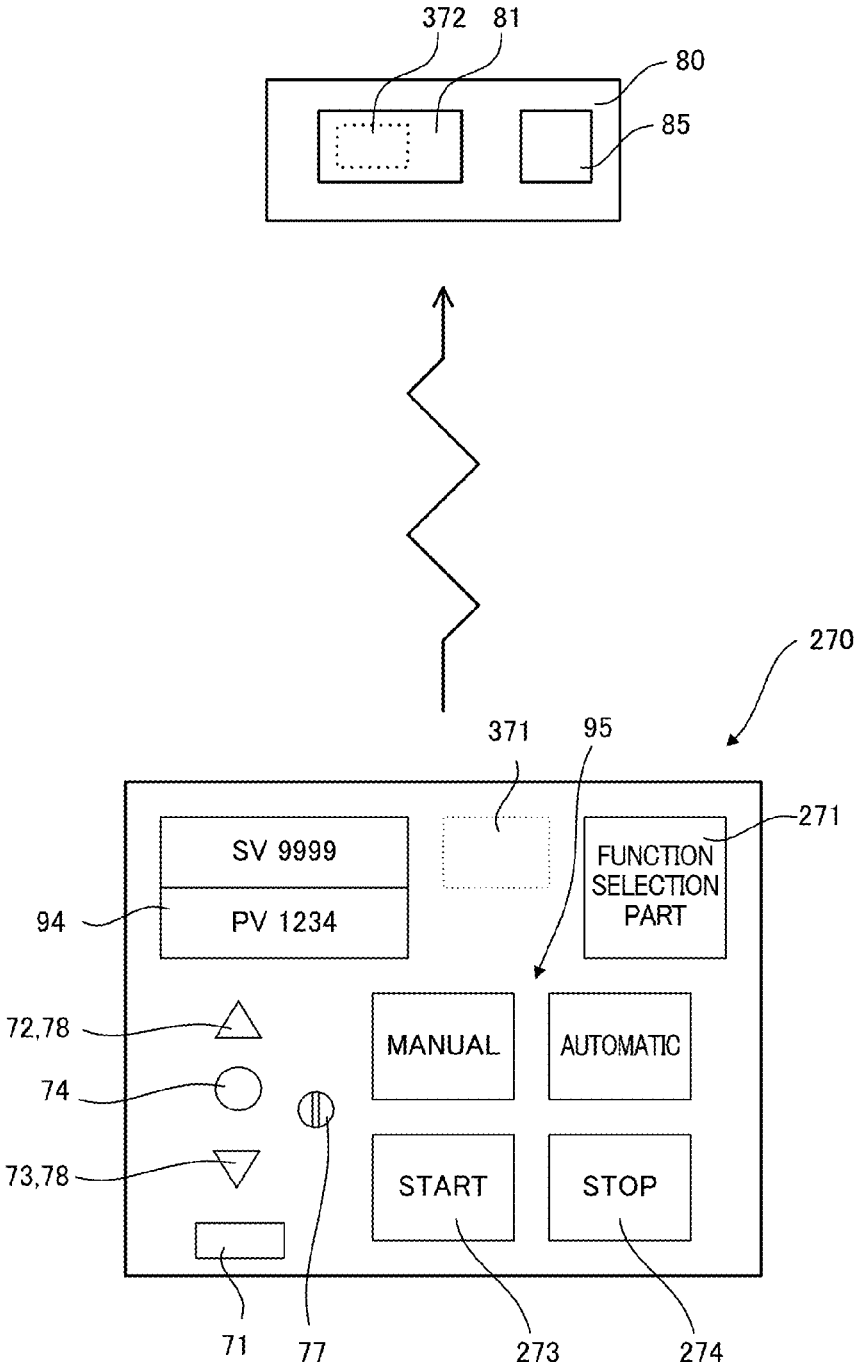
FIG. 9 illustrates a wireless input part of the electric slide fastener system according to the second embodiment.

FIG. 9 illustrates the wireless input part 270 of the electric slide fastener system 10 according to the second embodiment.

The wireless input part 270 is included in the control unit 7. Like the slider 6, the wireless input part 270 includes a power switch 71, a closing switch 72, an open switch 73, a stop switch 74, a driving speed change switch 77, a target position input part 78, and a position display part 94. In the second embodiment, the closing switch 72 and the open switch 73 also serve as the target position input part 78.

The closing switch 72, the open switch 73, and the target position input part 78 have different functions depending on whether the control is manual or automatic. In manual control, the switches function as the closing switch 72 and the open switch 73. The switches are pressed to move the slider 6 in the closing direction or the open direction. The stop switch 74 is pressed to stop the slider 6. In automatic control, the switches function as the target position input part 78. The switches are pressed to input a target position. The stop switch 74 is pressed to reset the target position.

Unlike the input part 70 of the control unit 7 provided on the slider 6, the wireless input part 270 includes a function selection part 271, a start button 273, a stop button 274, and the manual/automatic switch display part 95.

The function selection part 271 is a button for switching between a manual mode, an automatic mode, a target position input mode, and other modes (such as a failure diagnosis mode and an operation description mode using voice). In the manual mode, the slider 6 is moved by manual operations. In the automatic mode, the slider 6 is automatically moved to and stopped at a predetermined target position. In the target position input mode, the predetermined target position is input. The automatic mode may include an automatic stop control at the stroke ends as in the first embodiment described in the present specification. The automatic mode may include a target position stop control as in the second embodiment. Both the controls may be combined. In the manual mode, the slider 6 moves while operation command switches such as the closing switch 72 and the open switch 73 are manually pressed. For example, if the target position input mode is selected, the buttons of the target position input part 78 can be pressed to set a target position such as the number of elements 3, a distance from the current position of the slider 6, a distance from the top stops 4 or the bottom stop 5, and time. The setting is preferably displayed like a character string and a numeral string displayed on the position display part 94 of FIG. 9. If the target position does not need to be changed, the target position may be stored in a storage part 85 in advance, in which case the target position input mode is not needed. If the manual mode or the automatic mode is selected, the selection is preferably displayed by lighting a text area "manual" or "automatic" of the manual/automatic switch display part 95 illustrated in FIG. 9.

The start button 273 is a switch for starting to move the slider 6 in the automatic mode after the target position is set. The stop button 274 is a switch for emergency stop.

The wireless input part 270 wirelessly transmits signals to the control part 80 of the slider 6. The wireless input part 270 includes a first wireless signal conversion part 371 which generates a wireless signal according to the set value determined by the target position input part 78. The first wireless signal conversion part 371 has the function of generating wireless signals corresponding to the operation of all the switches and buttons included in the wireless input part 270, not only the set value of the target position input part 78. The control part 80 includes a reception part 81 for receiving the signals from the wireless input part 270. The control part 80 further includes a second wireless signal conversion part 372 which converts the wireless signal according to the value set by the target position input part 78 into a signal to be stored in the storage part 85 of the control part 80 of the slider 6. The second wireless signal conversion part 372 has the function of converting all the wireless signals transmitted from the wireless input part 270 into electric signals needed for the control of the slider 6.

A mobile communication terminal of touch panel type may be used as the wireless input part 270. More specifically, a mobile communication terminal such as a smartphone may be used. In such a case, a dedicated application is preferably used for operation. The button arrangement illustrated as the wireless input part 270 in FIG. 9 may be displayed on the screen of the mobile communication terminal.

The provision of the wireless input part 270 enables the slider 6 to be controlled from a position remote from the slider 6. In addition, the state of the slider 6 can be appropriately recognized.

Next, an external power feeding method used in the electric slide fastener system 10 according to the present embodiment will be described.

Figure 10:
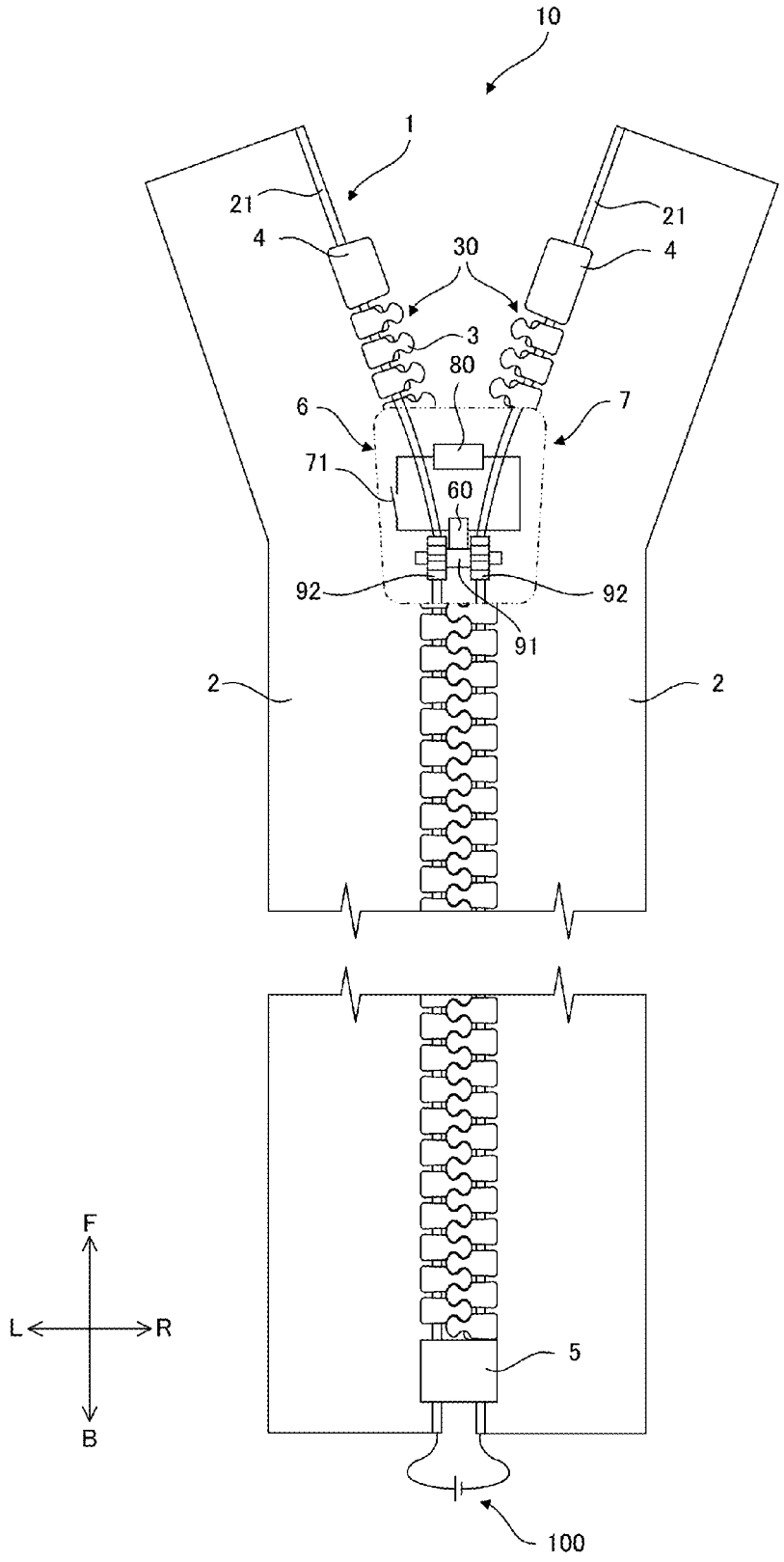
FIG. 10 illustrates a power feeding method that can be used in the electric slide fastener system according to the present embodiment.

FIG. 10 illustrates a power feeding method that can be used in the electric slide fattener system 10 according to the present embodiment.

In the power feeding method illustrated in FIG. 10, the opposed conductive parts 21 of the fastener tapes 2 are made of conductive material. A current flows through the conductive parts 21 from an external power supply 100 of DC 5 to 24 V. The current flows from the conductive parts 21 to the control part 80 and the driving part 91 via the transmission part 92, the power supply 60, and the power switch 71. In a first example, the transmission part 92 includes conductive gears. The driving part 91 can rotate the transmission part 92 to move the slider 6.

The use of the conductive parts 21 of the fastener tapes 2 for power feeding enables stable power supply with efficient use of space. Since the transmission part 92 driven by the driving part 91 also serves as contact parts 113 for making electrical connection with the conductive parts 21, the parts count can be reduced.

Figure 11:
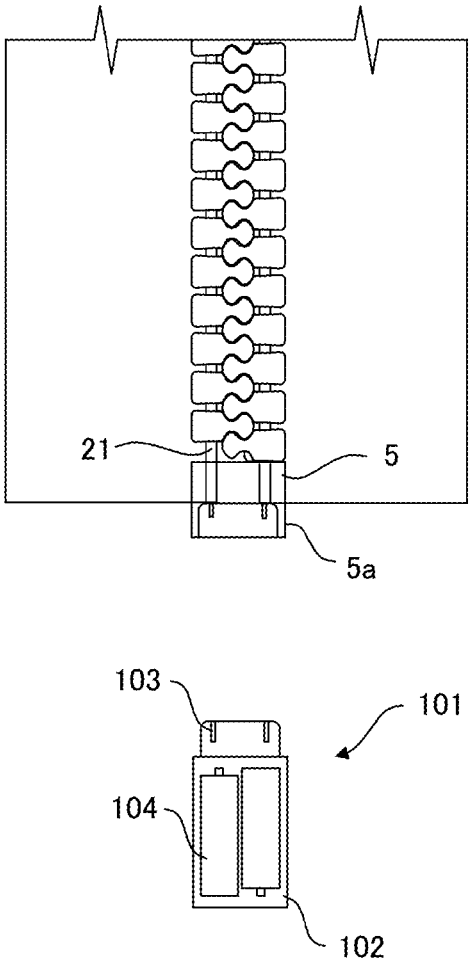
FIG. 11 illustrates an example in which an external battery unit is used for the power feeding method illustrated in FIG. 10.

FIG. 11 illustrates an example in which an external battery unit 101 is used for the power feeding method illustrated in FIG. 10.

As illustrated in FIG. 11, the external battery unit 101 may be used instead of power supply from the external power supply in the power feeding method illustrated in FIG. 10. The external battery unit 101 includes a unit-side connector 103 formed on a case 102 which accommodates batteries 104. A bottom stop-side connector 5*a* capable of connection to the connector 103 is formed on the bottom stop 5 of the slide fastener chain 1. If the unit-side connector 103 of the external battery unit 101 is connected to the bottom stop-side connector 5*a*, a current can be passed through the control part 80 and the driving part 91 via the transmission part 92 and the power switch 71 as in the example illustrated in FIG. 10.

The external battery unit 101 can thus be used for easy power supply.

Figure 12:
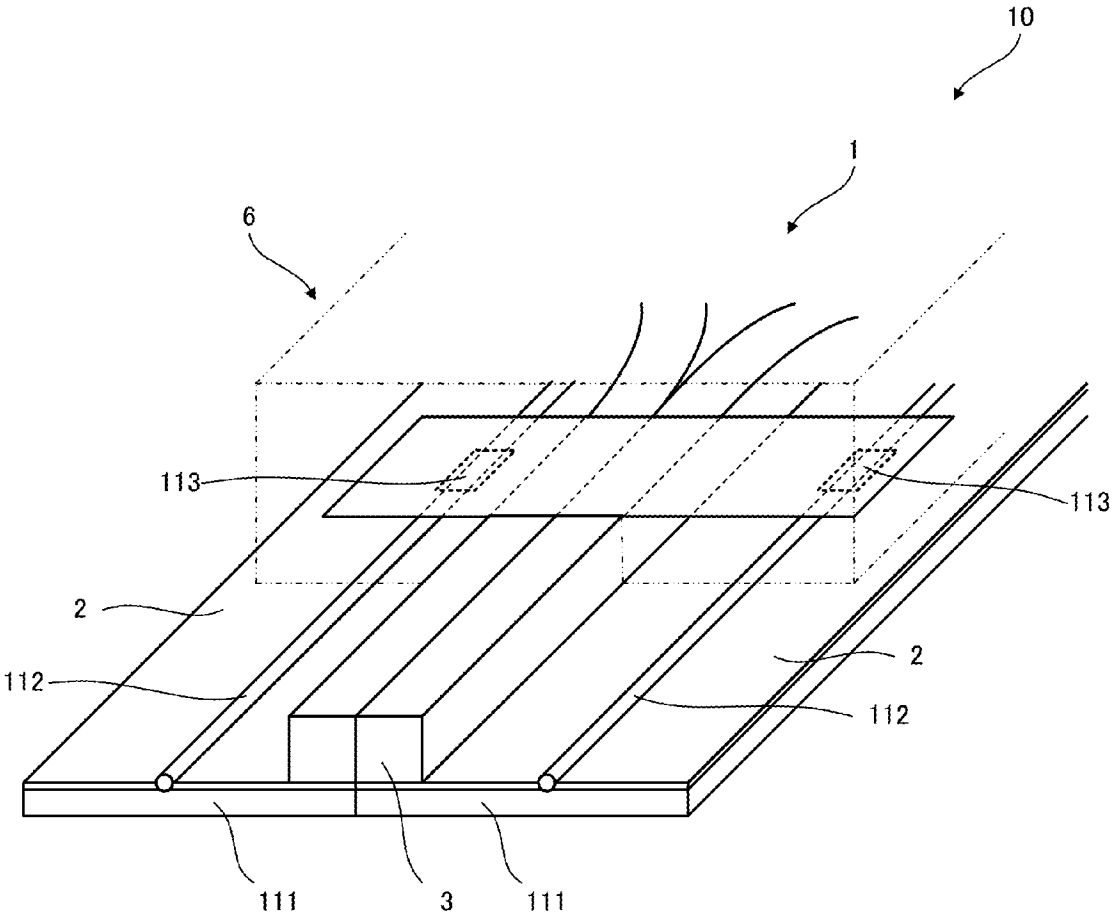
FIG. 12 illustrates a power feeding method that can be used if a slide fastener chain of the electric slide fastener system according to the present embodiment has a waterproof function.
Figure 13:
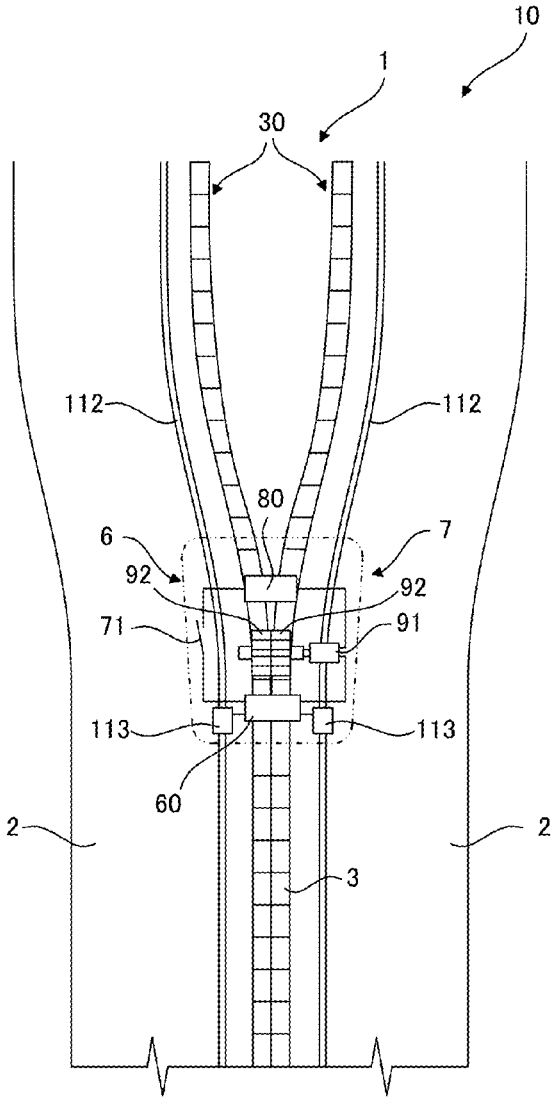
FIG. 13 illustrates a front view of the electric slide fastener system having the waterproof function.
Figure 13:
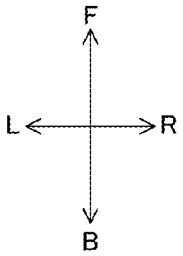
Figure 14:
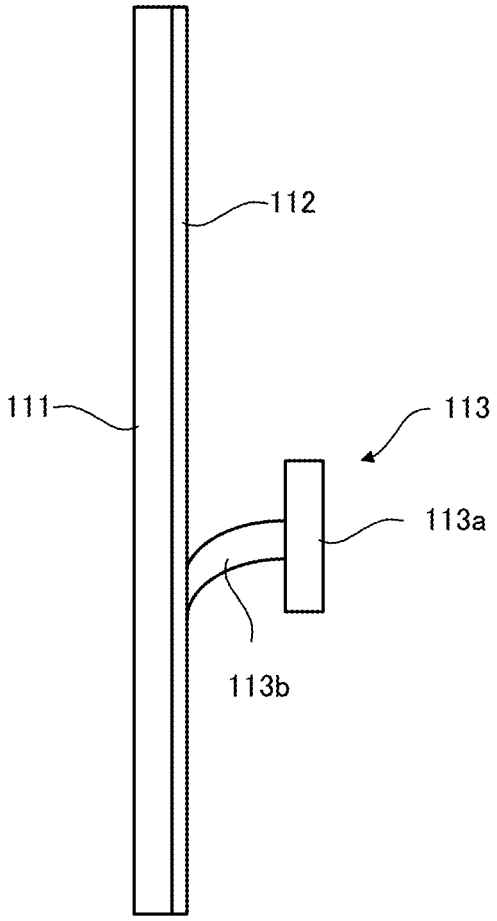
FIG. 14 illustrates a contact part of the electric slide fastener system having the waterproof function.

FIG. 12 illustrates a power feeding method that can be used if the slide fastener chain 1 of the electric slide fastener system 10 according to the present embodiment has a waterproof function. FIG. 13 illustrates a front view of the electric slide fastener system 10 having the waterproof function. FIG. 14 illustrates a contact part 113 of the electric slide fastener system 10 having the waterproof function.

If the slide fastener chain 1 has the waterproof function, the slide fastener chain 1 includes resin coating parts 111 on the opposite side of the fastener tapes 2 and the elements 3 from the slider 6. Conductive parts 112 are arranged on the fastener tapes 2 along the element rows 30. The slider 6 includes contact parts 113 for making contact with the conductive parts 112. The contact parts 113 are included in the control unit 7. The contact parts 113 make contact with the conductive parts 112 to feed the power supplied from the external power supply 100 illustrated in FIG. 10 or the external battery unit 101 illustrated in FIG. 11 to the control part 80 and the driving part 91 via the power supply 60 and the power switch 71. In other words, the conductive parts 112 and the contact parts 113 are included in a power feed mechanism for supplying power to the power supply 60. In the present embodiment, the rechargeable power supply 60 is described to be mounted on the slider 6. However, without the power supply 60 being mounted, the power supplied from outside may be fed to the control part 80 and the driving part 91 via the power switch 71.

The contact parts 113 make contact with the conductive parts 112 via contacts 113*b* extending from their contact part main bodies 113*a*. The contacts 113*b* are made of flexible conductive material. The contacts 113*b* are formed to be somewhat longer than the distance from the contact part main bodies 113*a* to the conductive parts 112. As illustrated in FIG. 14, the contacts 113*b* can thus make contact with the conductive parts 112 even while the slider 6 is moving.

In such a manner, even if the slide fastener chain 1 has the waterproof function, power can be stably supplied.

In the example illustrated in FIG. 10, the transmission part 92 also has the function of the contact parts 113. More specifically, in the example illustrated in FIG. 10, the transmission part 92 makes contact with the conductive parts 112 to feed the power supplied from the external power supply 100 illustrated in FIG. 10 or the battery unit 101 illustrated in FIG. 11 to the control part 80 and the driving part 91 via the power switch 71. The transmission part 92 thus constitutes the contact parts.

Figure 15:
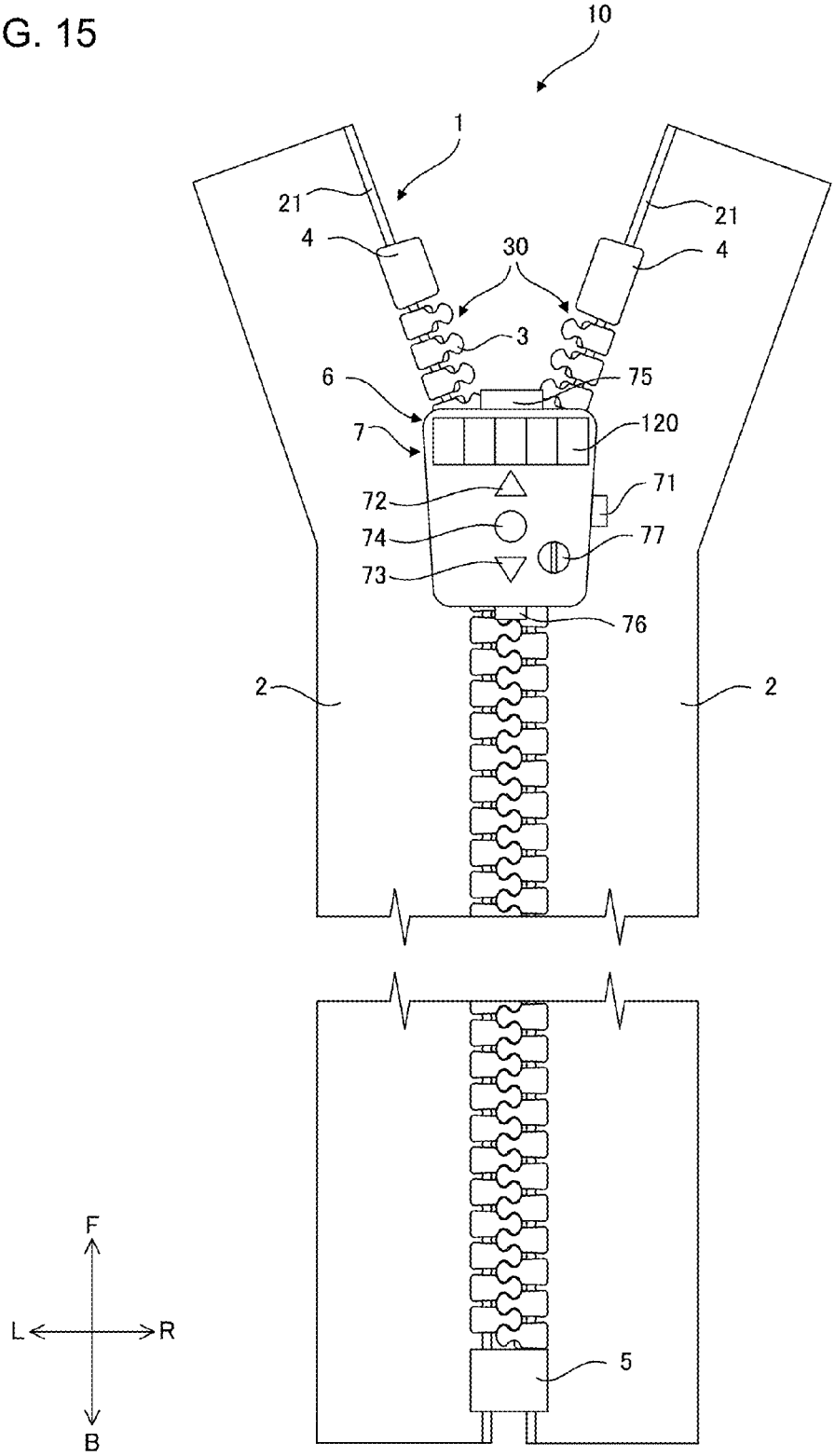
FIG. 15 illustrates another power feeding method that can be used in the electric slide fastener system according to the present embodiment.

FIG. 15 illustrates another power feeding method that can be used in the electric slide fastener system 10 according to the present embodiment.

In the example illustrated in FIG. 15, a solar panel 120 serving as the power supply 60 is arranged on the control unit 7 of the slider 6. The solar panel 120 is preferably arranged in a position on the slider 6 where the solar panel 120 gets a lot of sunlight.

In such a manner, the external power supply mechanism solar panel 120 can be used to charge the power supply 60 while supplying power to the driving part 91. This enables stable power supply with efficient use of space.

As described above, the electric slide fastener system 10 according to the present embodiment includes the slide fastener chain 1 which includes the pair of fastener tapes 2 and the element rows 30 including the plurality of elements 3 fixed to the respective fastener tapes 2, the slider 6 which moves with respect to the slide fastener chain 1, the power supply 60 which supplies power for the slider 6 to move with respect to the slide fastener chain 1, and the driving part 91 to which the power is fed from the power supply 60 and which moves the slider 6 with respect to the slide fastener chain 1. The elements 3 pass through the slider 6 to close or open the element rows 30. The slider 6 is powered from outside. The electric slide fastener system 10 of the present embodiment can operate appropriately according to the state of the electric slider.

In the electric slide fastener system 10 of the present embodiment, the power supply 60 is mounted on the slider 6. The electric slide faster system 10 has the power feed mechanism for supplying power to the power supply. According to the electric slide fastener system 10 of the present embodiment, power can be stably supplied.

In the electric slide fastener system 10 of the present embodiment, as the power feed mechanism, the pair of fastener tapes 2 includes the conductive parts 112 which are connected to the power supply 60 and arranged along the respective element rows 30. The slider 6 includes the contact parts 113 which pass a current from the conductive parts 112 to the power supply 60. The electric slide fastener system 10 of the present embodiment can thus stably supply power while effectively using the space.

In the electric slide fastener system 10 of the present embodiment, the contact parts 113 are driven by the driving part 91. According to the electric slide fastener system 10 of the present embodiment, parts can thus be used for more than one use to reduce the parts count.

In the electric slide fastener system 10 of the present embodiment, the contact parts 113 include the contacts 113*b* which are formed of flexible conductive material. The contacts 113*b* make contact with the conductive parts 112. According to the electric slide fastener system 10 of the present embodiment, power can thus be more stably supplied.

In the electric slide fastener system 10 of the present embodiment, the resin coating parts are provided on a side of the pair of fastener taps 2 opposite from the side where the conductive parts are arranged. According to the electric slide fastener system 10 of the present embodiment, a fastener having a waterproof function can thus be provided.

In the electric slide fastener system 10 of the present embodiment, the power feed mechanism includes the solar panel arranged on the slider 6. According to the electric slide fastener system 10 of the present embodiment, the slider 6 can supply power to the driving part 91 by itself without power supply from outside. This enables stable power supply with efficient use of space.

While various embodiments of the present invention have been described, the present invention is not limited to only such embodiments. Embodiments constituted by appropriately combining the configurations of the foregoing embodiments are also embraced within the present invention.

What is claimed is:

1. An electric slide fastener system comprising:

a slide fastener chain that includes a pair of fastener tapes and element rows including a plurality of elements fixed to the respective fastener tapes;

a slider that moves with respect to the slide fastener chain;

a power supply that supplies power for the slider to move with respect to the slide fastener chain; and a power feed mechanism for supplying power to the power supply;

the elements passing through the slider to open or close the element rows, wherein the power supply is mounted on the slider, the power feed mechanism includes conductive parts and contact parts, the pair of fastener tapes includes the conductive parts that are connected to the power supply and arranged along the respective element rows, and the slider includes the contact parts that pass a current from the conductive parts to the power supply.

2. The electric slide fastener system according to claim 1, wherein the contact parts are driven by the driving part.

3. The electric slide fastener system according to claim 1, wherein:

the contact parts include contacts made of flexible conductive material; and the contacts make contact with the conductive parts.

4. The electric slide fastener system according to claim 3, further comprising a resin coating part on a side of the pair of fastener tapes opposite from a side where the conductive parts are arranged.

5. An electric slide fastener system comprising:

a slide fastener chain that includes a pair of fastener tapes and element rows including a plurality of elements fixed to the respective fastener tapes;

a slider that moves with respect to the slide fastener chain;

a power supply that supplies power for the slider to move with respect to the slide fastener chain; and a power feed mechanism for supplying power to the power supply;

the elements passing through the slider to open or close the element rows, wherein the power supply is mounted on the slider, and the power feed mechanism includes a solar panel arranged on the slider.

* * * * *